US006575880B1

(12) United States Patent
Hengtrakulsin

(10) Patent No.: US 6,575,880 B1
(45) Date of Patent: Jun. 10, 2003

(54) ANTERIOR LOADING APPARATUS FOR STRENGTHENING A USER'S MID-TORSO AND INNER SPINE, AND FOR POSTURE TRAINING

(76) Inventor: Prapawadee Hengtrakulsin, 594/52 Soi Mahawong North, Asoke-Dindaeng Road, Dindaeng District, Bangkok (TH), 10320

( * ) Notice: Subject to any disclaimer, the term of this patent is extended or adjusted under 35 U.S.C. 154(b) by 378 days.

(21) Appl. No.: 09/645,030

(22) Filed: Aug. 22, 2000

(51) Int. Cl.[7] ..... A63B 21/08; A63B 23/02

(52) U.S. Cl. ..... 482/97; 482/98; 482/100; 482/137; 482/139

(58) Field of Search ..... 482/10, 97, 98, 482/100, 92–94, 105, 148, 137–139; 602/36; 601/39

(56) References Cited

U.S. PATENT DOCUMENTS

| | | | | | |
|---|---|---|---|---|---|
| 1,047,212 | A | * | 12/1912 | Hamilton | 482/105 |
| 3,850,431 | A | * | 11/1974 | Winans | 482/98 |
| 4,121,577 | A | * | 10/1978 | Binder | 606/237 |
| 4,460,171 | A | * | 7/1984 | Plyhm | 482/10 |
| 4,854,578 | A | * | 8/1989 | Fulks | 482/100 |
| 5,199,940 | A | | 4/1993 | Morris et al. | |
| 5,472,398 | A | * | 12/1995 | Silverman | 482/105 |
| 5,484,388 | A | | 1/1996 | Bassett et al. | |
| 5,893,818 | A | | 4/1999 | Zahiri et al. | |
| 5,941,807 | A | | 8/1999 | Cassidy et al. | |
| 6,015,370 | A | | 1/2000 | Pandozy | |

FOREIGN PATENT DOCUMENTS

| | | | | |
|---|---|---|---|---|
| FR | 779572 | * | 4/1935 | 482/105 |
| SU | 1477433 | * | 5/1989 | 482/138 |

OTHER PUBLICATIONS

Schwarzenegger, A., Arnold Schwarzenegger Encyclopedia of Modern Bodybuilding, Simon & Schuster, Inc., NY, NY, 1987, pp. 470 and 495.*

(List continued on next page.)

*Primary Examiner*—Jerome W. Donnelly
*Assistant Examiner*—Victor Hwang

(57) ABSTRACT

An anterior loading apparatus and a method for strengthening a user's torso inner spine and muscles thereof, and training the user to hold a correct upright posture providing awareness of the proper spinal alignment comprises a frame assembly including a base member, a pair of vertical frame members, a vertical torso support means, both affixed to and extending upwardly from the base member, and a loading beam with one end pivotally mounted at the upper section of the pair of vertical frame members and the other end extending beyond and above the top end of the vertical torso support means which is spaced apart from and aligned with a mid-plane of the pair of vertical frame members. The projecting portion of the loading beam terminates in a liftable straight-edged free end having a pad mounted thereon. At least one weight is mounted to the mid-section of the loading beam to apply a vertical load thereto. A user operates the apparatus by applying the padded straight-edged free end on top of the axis of his or her anterior torso and lifting the padded free end up by straightening up his or her body and pushing forward his or her upper torso. The lifted free end in turn lifts the at least one weight mounted to the loading beam. The user is maintained to resist the vertical load thereon, whereby such apparatus urges the user to straighten up and push forward his or her upper torso. The vertically compressive force simulates gravity to strengthen the user's torso, inner spine and muscles thereof, while training the user to develop a habit of holding straight upright posture and to aware of proper spinal alignment, and enabling a hand-free weightlifting exercise.

13 Claims, 8 Drawing Sheets

OTHER PUBLICATIONS

Michele J. Grimm, "Hard Tissues", Lecture 3, Jan. 20, 1999, The Bioengineering Center of Wayne State University, Detroit, U.S.A.

Ramani Pichumani, "Spinal Structure", Dissertation: Construction of a 3D Geometric Model For Segmentation and Visualization of Cervical Spine Images, Jul. 7, 1997, Dept. of Medicine, Stanford University, Stanford, U.S.A.

Andrew W Wilson, HM Davies, Glenn A Edwards, Brian L Grills "Can Some Physical Therapy and Manual Techniques Generate Potentially Osteogenic Levels of Strain Within Mammalian Bone" Research Report, Physical Therapy Journal, Aug. 23, 1998, vol. 79 No. 10 Oct. 1999, American Physical Therapy Association, Danvers, U.S.A.

Robert O. Becker & Andrew A. Marino, "Electromagnetism & Life" Chapter 2: The Physiological Function of Intrinsic Electromagnetic Energy, @1982, State University of New York, Albany,USA.

William V. Zucker & Brian W. Nelson "Breakthrough For Back Pain", Oct. 1992, Lester Street Publishing, Tucson, U.S.A.

D.C. Xiao, B.S. Acar, K. Case, J.M. Porter, "Thrust Line Determination For the Human Spine Modelled as an Arch", Research Paper, Mar. 26, 1999, Loughborough University, Loughborough, U.K.

* cited by examiner

ANTERIOR LOADING APPARATUS FOR STRENGTHENING A USER'S MID-TORSO AND INNER SPINE, AND FOR POSTURE TRAINING

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

The field of endeavor to which the present invention pertains generally relates to the field of exercise and therapeutic machines. More particularly, the present invention relates to the field of resistance and weight-bearing exercise machines for strengthening the torso, the inner spine and muscles thereof.

Over the past several years, there has been exercise machines being developed for strengthening the spine and torso. However, no real effort has been made to develop a machine which is particularly adapted for directly strengthening the torso, the inner spine and muscles thereof through applying a vertically compressive force directly on top of a user's upright torso axis which can be performed without straining the neck and without causing any range of motion, or, in other words, a hand-free weightlifting exercise.

In prior art patent as disclosed in the U.S. Pat. No. 5,893,818, dated Apr. 13, 1999, issued to Zahiri et al., entitled "Axial Loading Apparatus For Strengthening The Spine" in which the compressive force is applied through head loading. Taken into consideration, a vertical compressive force loaded on top of a patient's head cannot avoid compressing the neck which is the narrowest part of the body and susceptible to injury through overloading force. In order to save the neck, the force applied is used to be too small to be effective in strengthening the lower portion of the torso which is much larger and thicker than the upper including the neck.

On the other hand, existing devices and apparatuses for strengthening the torso and the spine often damage the strength of the bony structure of the spine including the intervertebral discs thereof through strenuous exercise with various motions of the torso being performed under various forms of resistance. This can cause frictions and irreversible damages to the bony structure of the spine and muscles thereof.

Meanwhile, many other exercise machines arrange the users to be in horizontal positions in which the users are deprived of the great advantage of the gravitational loading for the skeletal formation as become an obvious basis of the rehabilitation science. A cited example of such is in the U.S. Pat. No. 6,015,370 dated Jan. 18, 2000, issued to Pandozy, entitled "Combined Therapeutic Exercise Apparatus For The Back".

In the conventional weightlifting exercise, weightlifters gain full benefits of the gravitational force applied to strengthen their bodies. However weightlifting exercise has discouraged many people due to its highly exhaustible type of exercise and prerequisite of a strong health including an efficient range of motion which many people do not possess.

In treatment of the prevailing back pain, particularly, the lumbar back pain, existing devices and apparatuses often fail to localize and tackle the weak point persisting at the inner convex side of the lumbar spine. According to Wolff's law, bone growth occurs on the concave side and bone resorption on the convex side. This means the concave side of the lumbar spine is stronger with more density of bone mass than its opposite convex side. In order to cure the lumbar back pain effectively, all sides of the lumbar spinal column must be equally strengthened. Again, Wolff's law is referred which states that bone mass and density will be increased in areas of stress. The detrimental effect of immobilization and non-weight bearing environments is the significant reduction in bone density. To give the convex side of the lumbar spine an equal chance of rehabilitation in a stress and weight-bearing environment, it deserves our consideration to provide an apparatus and a method to apply an adequate vertically compressive force directly to the convex side of the lumbar spine which is hidden inside the torso.

The present invention anterior loading apparatus is thus developed to overcome all the shortcomings mentioned above by utilizing the vertical or axial load to apply a compressive force directly on the inner spine at its convex side localized within the torso and the surrounding muscles and ligaments thereof effectively. The present invention anterior loading apparatus and its method of operation require neither strenuous exercise, range of motion, nor vigorous health of the user, straining neither the neck nor the limbs, causing neither friction nor damage to the bony structure of the spine, but increasing the strength of the overall torso, including the inner spine, muscles and ligaments thereof. The anterior loading apparatus directs an adequate compressive force from top of the upright torso axis to strengthen the inner convex side of the lumbar spine whose weight-bearing function in normal situation is likely to be underused. Therefore, the present invention apparatus and method render the right solution to the weakness and chronic pain in the lumbar spine region.

In addition, the anterior loading apparatus and its operation method train the user to form his or her spinal line in close alignment with the load thrust line which is for the best performance and safety of the spinal column in carrying its function of bearing the body weight and external loads. The load thrust line is the line of action of the loads carried by the spinal structure. By means of repetitive training with the present invention anterior loading apparatus, the user is encouraged to form the desirable habit of holding a straight upright posture and preventing the undesirable posture of slouching back and shoulders. Other posture training devices, for example, in the U.S. Pat. No. 5,199,940 dated Apr. 6, 1993 issued to Morris et al., entitled "Posture Training And Correcting Device" does not train the user's awareness of proper alignment of the spinal line with the load thrust line.

BRIEF SUMMARY OF THE INVENTION

The present invention is an anterior loading apparatus and a method for strengthening a person's torso, inner spine, ligaments and muscles thereof and for training the person to aware of the proper spinal alignment and to develop a desirable habit of holding straight upright posture by applying a vertically compressive force directly on top of a user's upright anterior torso axis, defined at the base of the front neck between the two collarbones, whereby the user is urged to straighten up, pushing forward his or her upper chest, holding in his or her abdominal muscles and maintained in such position for a period of time, whereby the compressive force strengthens the user's torso, inner spine, ligaments and muscles thereof while developing the person's upright posture and awareness of the proper spinal alignment.

Accordingly, several objects and advantages of my present invention are:

(a) to provide an anterior loading apparatus and a method for strengthening a user's torso, inner spine, ligaments and muscles thereof by applying a compressive force vertically on top of the anterior body of the user;

(b) to provide an anterior loading apparatus and a method for training a user to form the habit of holding straight upright posture and discourage the habit of holding slouching posture by urging a vertical load on top of the anterior body of the user;

(c) to provide an anterior loading apparatus and a method for applying a compressive force to strengthen a user's body without compressing the user's neck and causing injuries thereto;

(d) to provide an anterior loading apparatus and a method for performing a hand-free weight-bearing exercise;

(e) to provide an anterior loading apparatus and a method for applying a mechanical compression to top of the anterior torso axis to simulate gravity to rehabilitate the underused convex side of the lumbar spine;

(f) to provide an anterior loading apparatus and a method for training a user to align the spinal line with the load thrust line for the optimum performance of the spinal structure;

(g) to provide an anterior loading apparatus with a means for vertically and horizontally adjusting the apparatus to fit different body dimensions of individual users;

(h) to provide an anterior loading apparatus with a means for selecting the amount of compressive force to suit different physical strength of individual users.

Further objects and advantages of my invention will become apparent from a consideration of the drawings and ensuing description.

DETAILED DESCRIPTION OF THE INVENTION

Although specific embodiments of the present invention will now be described with reference to the drawings. It should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The principal structural members of the present invention anterior loading apparatus (10) are preferably constructed of square and rectangular section steel tubing as is common practice for exercise equipment. The individual members are joined by welding or by mechanical fasteners as appropriate in each case.

Figure 1:
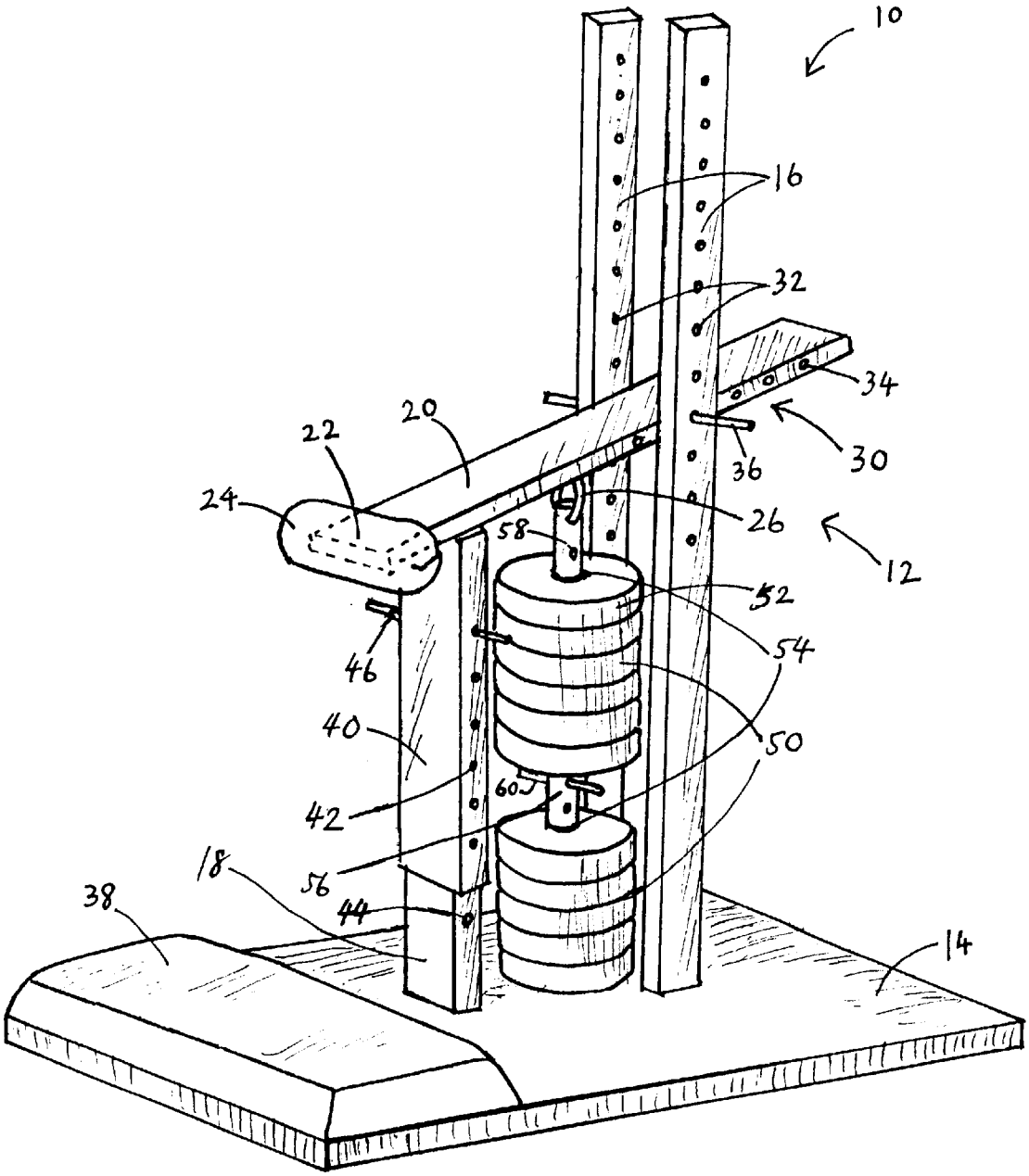
FIG. 1 is a perspective view of the apparatus of the present invention.
Figure 2:
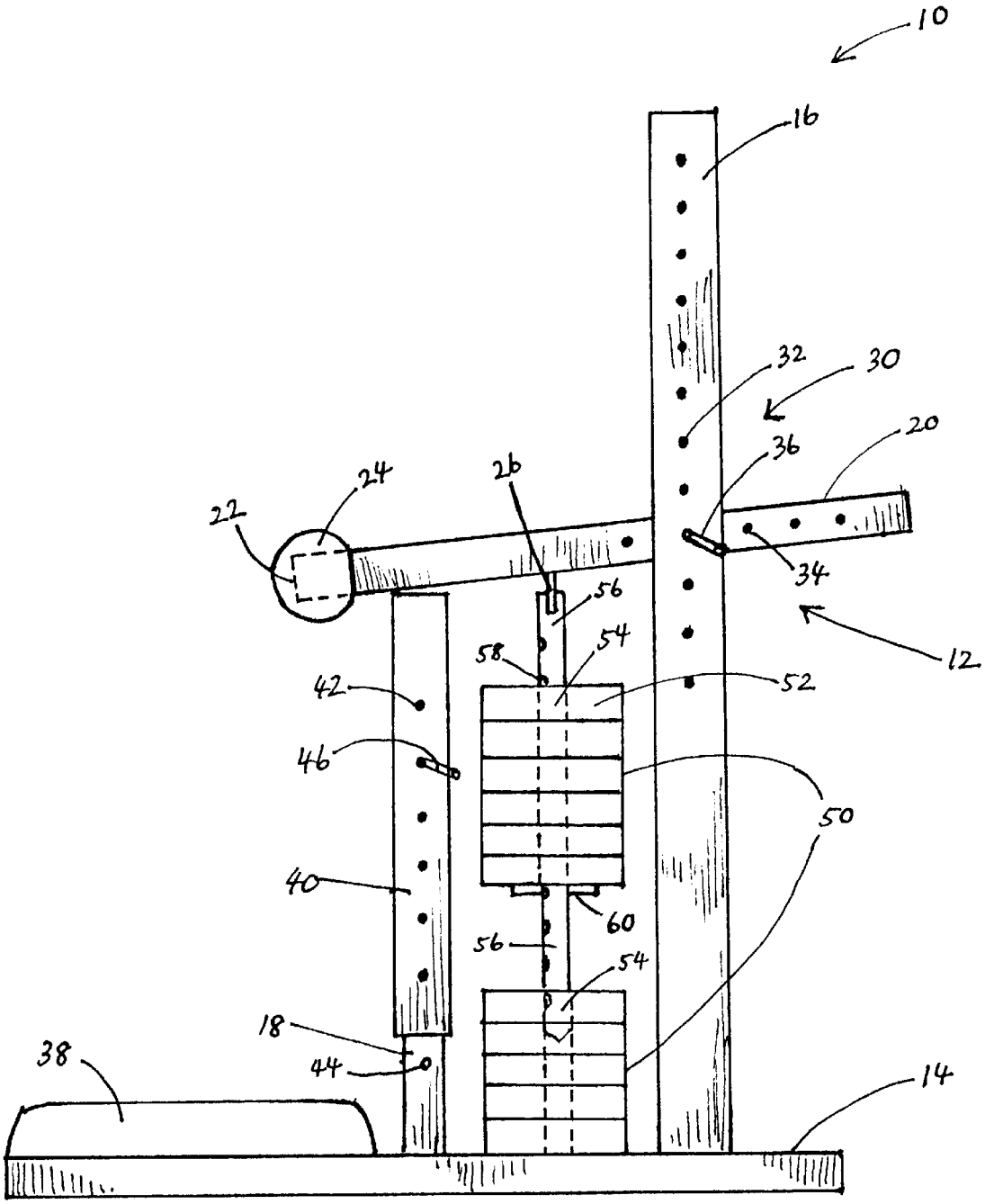
FIG. 2 is a side view of the apparatus of the present invention.
Figure 3:
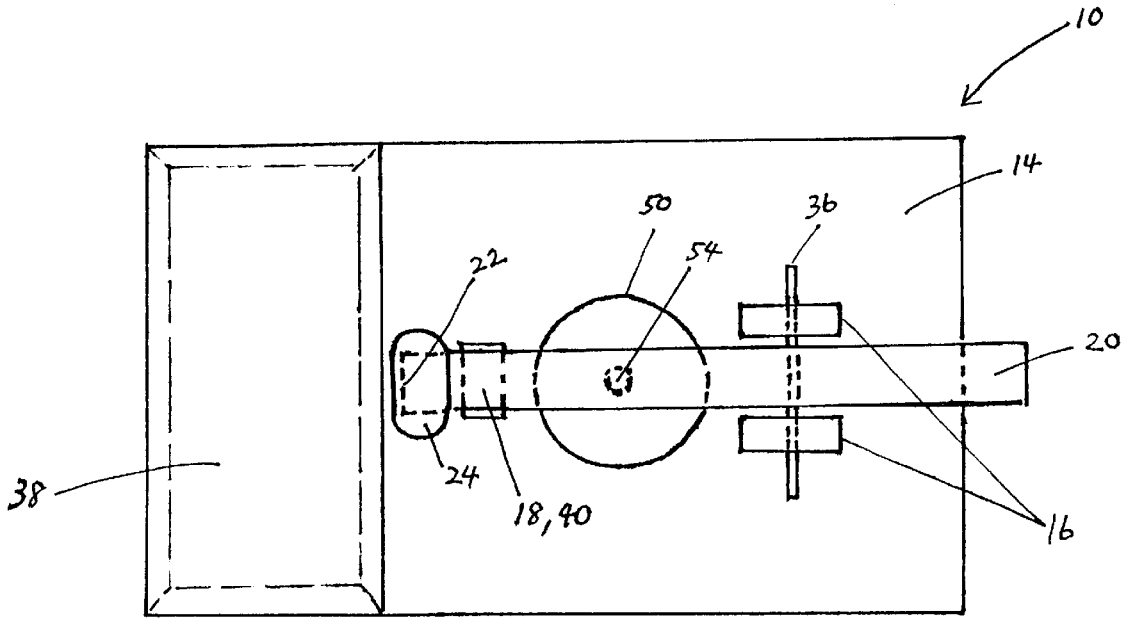
FIG. 3 is a top view of the apparatus of the present invention.

FIGS. 1, 2, and 3 illustrate various views of the anterior loading apparatus (10) of the present invention. As can be seen in FIGS. 1, 2, and 3, anterior loading apparatus (10) comprises a frame assembly (12) which has a generally flat base member (14) and a pair of generally vertical frame members (16) affixed to and extending upwardly from the base member (14). A vertical medial torso support means (18) is affixed to and extending upwardly from the base member (14) in a position that is spaced apart from and aligned with the mid-plane of the pair of vertical frame members (16) as shown in a top view in FIG. 3. The medial torso support means has a substantially straight front surface adapted to snugly engage a user's medial abdomen when the user's upright body is positioned adjacently facing and leaning against the medial torso support means. The vertical medial torso support means (18) is height adjustable. As such, a vertical adjustment means or a vertical extension (40) having a hollow part inside is slidably fitted on the top end of the vertical medial torso support means (18). A means for securing the vertical extension (40) with the vertical medial torso support means (18) at a desired height includes a plurality of adjustment horizontally through holes (42) spaced along the vertical extension (40), a plurality of corresponding through holes (44) spaced along the vertical medial torso support means (18), and a securing pin (46) inserted through one of the through holes (42) in the vertical extension (40) and through one the corresponding through holes (44) in the vertical medial torso support means (18) which determines the height level of the vertical extension (40) which is preferably about the height of the lower chest of the user in an upright position. The securing pin (46) is transversely oriented to the mid-plane of the vertical extension (40). A cross bar, a lever arm, or a loading beam (20) has one end pivotally mounted between the pair of vertical frame members (16) on the upper section thereof and the other end extending outwardly beyond the top end of the vertical extension (40) and terminating in a liftable, straight-edged, free end (22). An adjustment means (30) to selectively adjust the loading beam (20) vertically and horizontally to fit the height and the body dimension of individual users includes a series of horizontal through holes (32) correspondingly spaced along the upper section of each of the pair of vertical frame members (16), a series of similarly horizontal through holes (34) correspondingly spaced along the pivotal end section of the loading beam (20) and an axle pin (36) suitably dimensioned and removably inserted through a pair of the through holes (32) in the pair of vertical frame members (16), and through one of the corresponding holes (34) in the loading beam (20) sandwiched therebetween. Placement of the axle pin (36) determines the vertical and horizontal distances of the loading beam (20) relative to the pair of vertical frame members (16). The straight-edged free end (22) of the loading beam (20) has a width preferably of about the diameter of the human neck or approximately 4–5 inches. A pad (24) made of a kind of soft materials such as sponge, cloth or rubber encircles the straight edged free end (22) for minimizing the discomfort from an extended period of loading on the user's top torso. The pad (24) has a thickness of its layer at the outermost end approximately not more than 0.5 inch so that such thickness of the pad (24) does not obstruct the proper engagement of the straight-edged free end (22) with the base of the front neck (4) which may facilitate a direct loading of a desired vertically compressive force on top of the user's anterior torso axis.

At the mid section of the loading beam (20) and in the gap between the pair of vertical frame members (16) and the vertical medial torso support means (18), a mass or a plurality of weights (50) is coupled to the loading beam (20) for applying a vertical load to the loading beam (20). The amount of weights (50) is selectable as desired. As such, the plurality of weights (50) include stacked weight plates or discs (52), each of approximately 2.5 lbs. weight, having aligned, vertical central openings (54) therein. A vertical pick up rod or a selector rod (56), having apertures or selector holes (58) therethrough, extends downwardly from a top weight disc (52) through the vertical central openings (54) of the plurality of weights (50) and a weight stack pin or a coupling pin (60) inserted through one selector hole (58) in the selector rod (56) under the stack of the selected number of weight discs. The coupling pin (60) prevents the selected weight discs (52) from sliding down and off the selector rod (56) and allows ones not selected to be off and not coupled to the selector rod (56). A coupling means, a fastener or a hook (26) is attached to the top end of the selector rod (56) and serves to couple the selector rod (56) to the mid-section of the loading beam (20) between the pivotal end thereof and the portion above the top end of the vertical extension (40). A cushion (38) is removably provided at the outermost end of the base member (14) opposite to the pair of vertical frame members (16) for receiving the weight bearing portion of the user's body such as the shins in a kneeling position.

Figure 4:
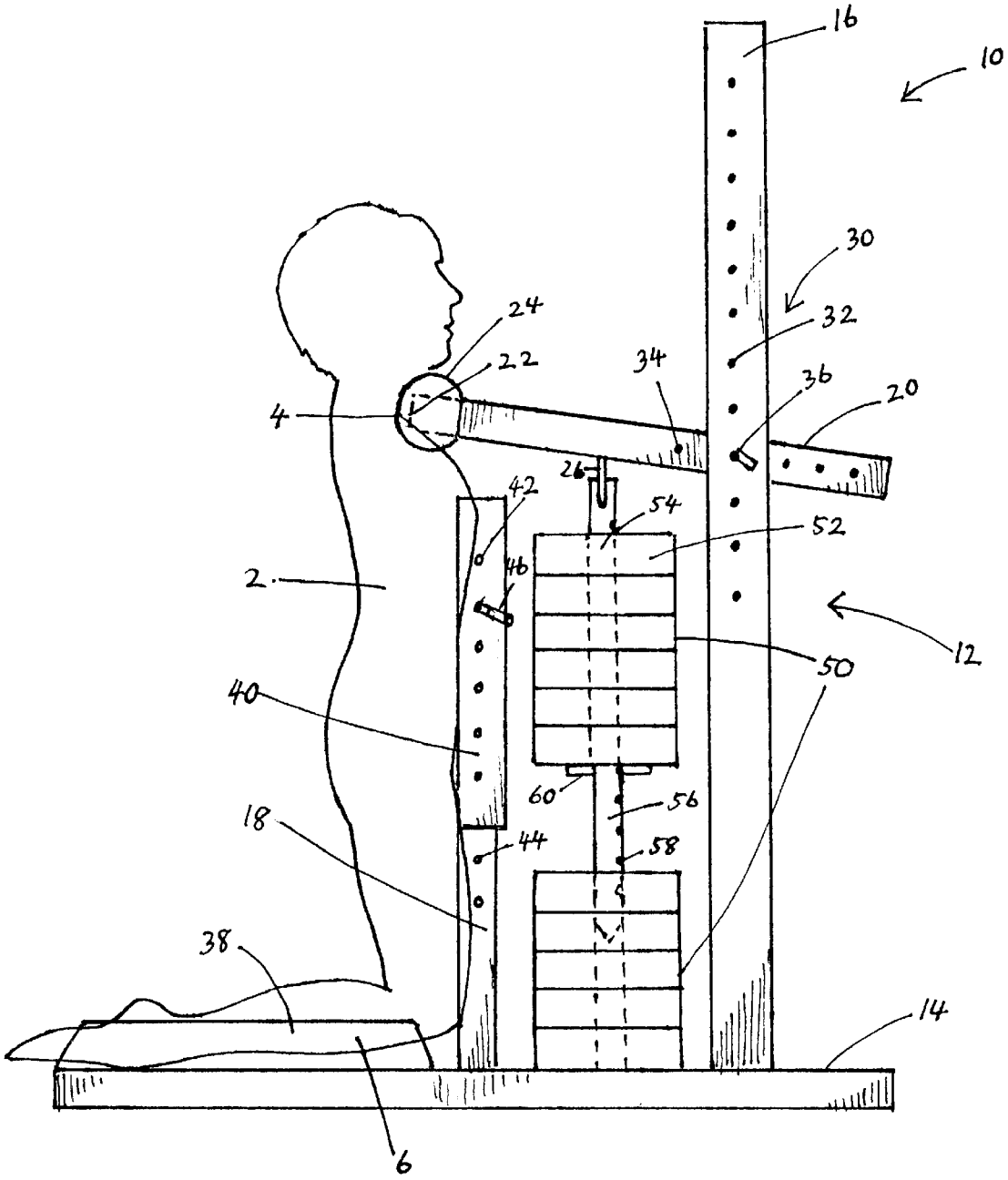
FIG. 4 is a side view of the apparatus of the present invention in its operable position on a human user in a kneeling position.
Figure 5:
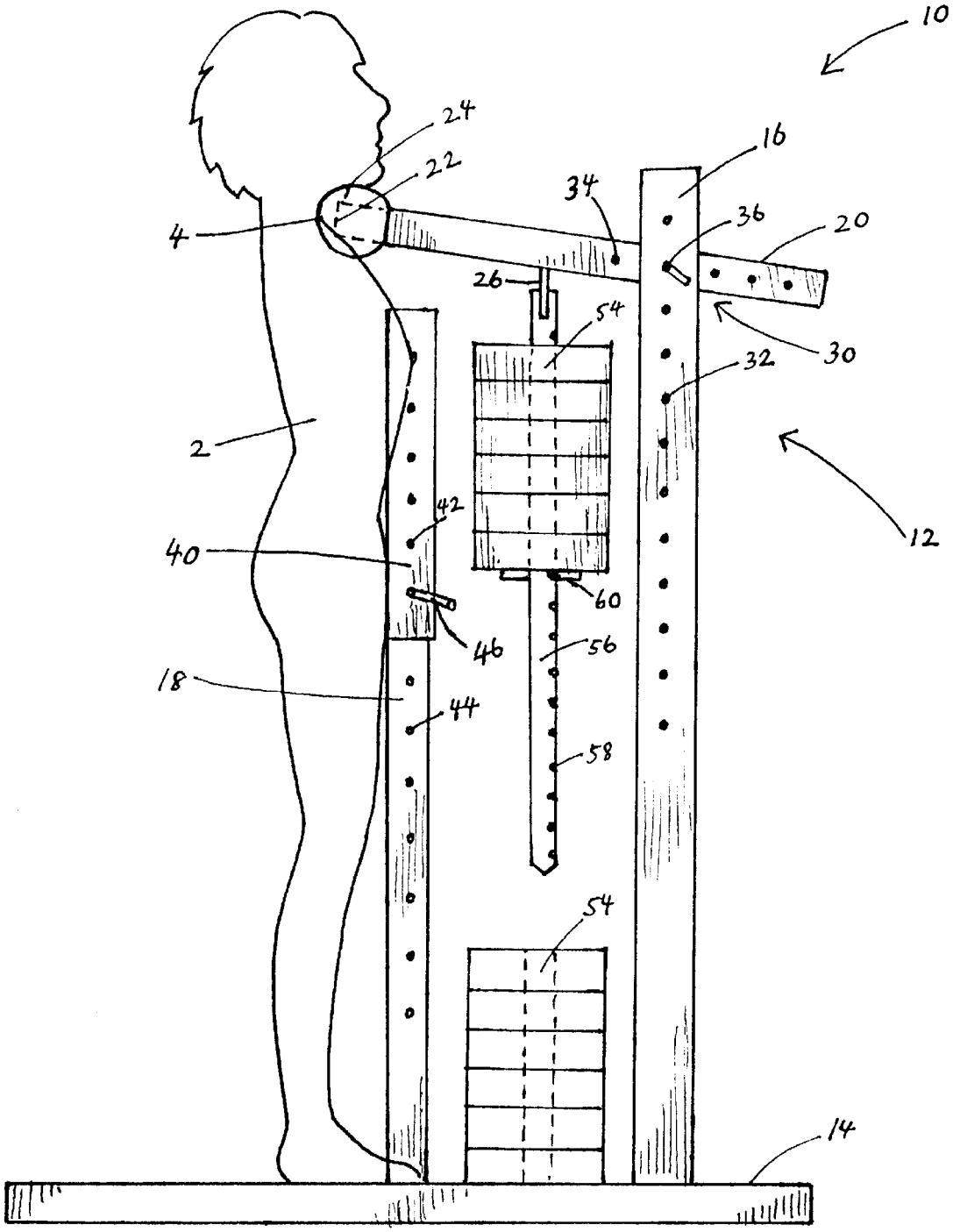
FIG. 5 is a side view of the apparatus of the present invention in its alternative operable position on a human user in a standing position.

FIG. 4 illustrates the apparatus being operated by a user (2) in a kneeling position while FIG. 5 illustrates the operation of the apparatus by a user (2) in a standing position. In FIG. 4, the height of the vertical extension (40) is adjustably maintained at approximately the level of the lower chest of the user (2) in a kneeling position while the height of the loading beam (20) at the pivotal end is adjusted to be approximately about the level of the upper chest of the user (2) and the length of the loading beam (20) is adjusted to be greater than the distance from the pair of vertical frame members (16) to the vertical medial torso support means (18) which renders the free end (22) of the loading beam (20) to project over the top end of the vertical extension (40). The projecting portion is adapted to engage with the loading area defined at the base of the front neck (4) of the user (2) in an upright position. The pad on the free end is adapted to provide a loading interface with the loading area. As urged by the load on top of the anterior torso axis, the user (2) straightens up, holding in his or her abdominal muscles and pushing forward his or her upper torso to resist and lift the load urged by the free end (22) of the loading beam (20) without using any hand and which in turn causes the loading beam (20) to lift upwardly the coupled weights (50). In an operable kneeling position, the user (2) may rest his or her shins and knees (6) on the cushion (38) on the base member (14) which serve as the user's weight bearing portion of the body and may face adjacently and lean against the vertical medial torso support means (18) and the vertical extension (40) during operation of the load resistance as aforementioned. The user (2) is maintained in such resisting position for a period of time, whereby the axially compressive force applied to the top of the user's anterior torso may strengthen the user's torso, inner spine and muscles thereof, and whereby the user (2) may be trained to develop a habit against holding slouching posture.

In FIG. 5, the user (2) operates the apparatus (10) in a standing position wherein vertical and horizontal adjustments to the apparatus (10) are similar to the adjustments mentioned in the operation embodied in FIG. 4, except that the vertical extension (40) and the loading beam (20) are readjusted vertically to higher levels to fit the standing user (2). The user (2) stands on the base member (14). The cushion (38) may be removed. Further steps of operation remain similar to that in FIG. 4.

Figure 6:
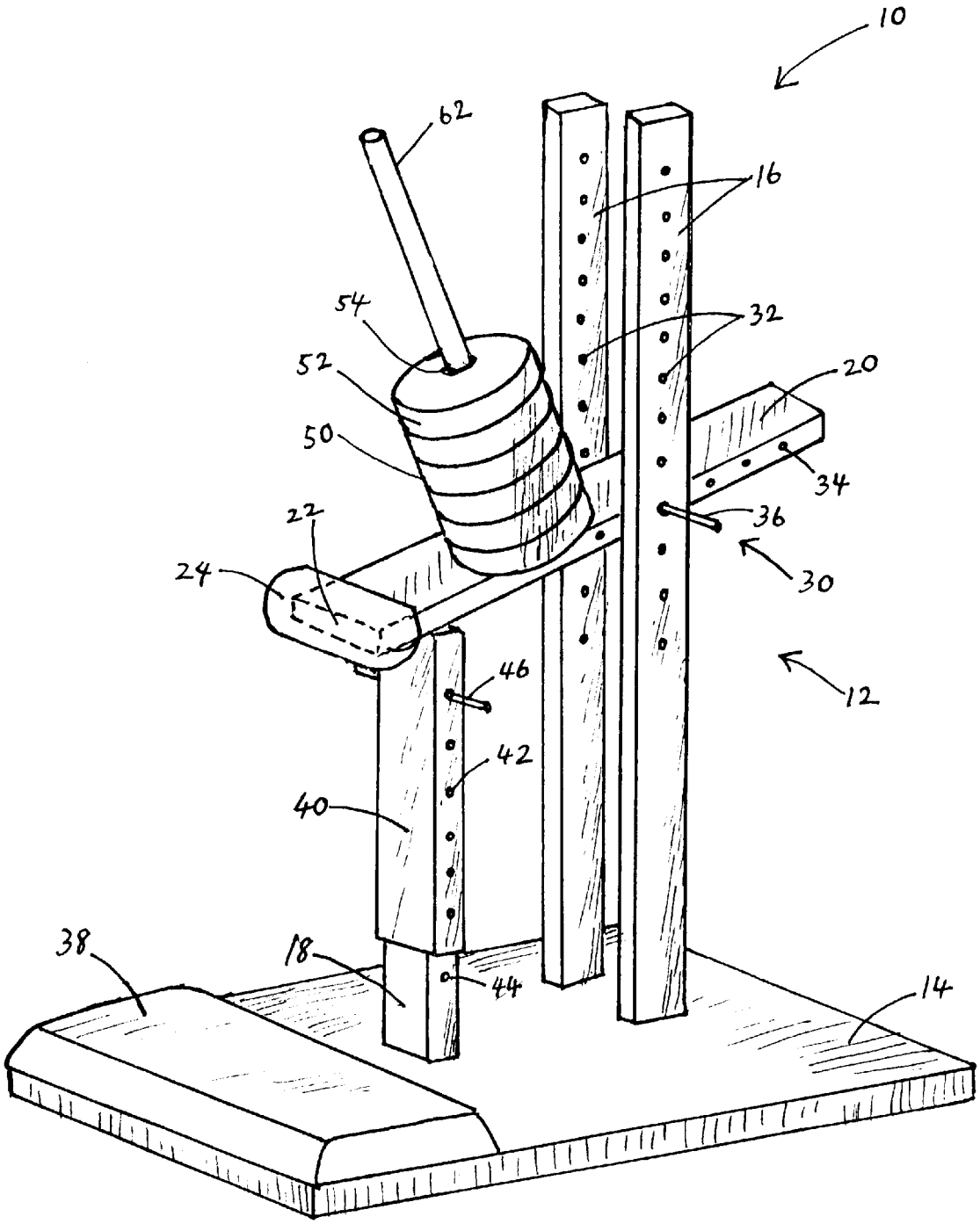
FIG. 6 is a perspective view of the apparatus of the present invention illustrating an alternative location of the weight stack above the loading beam.
Figure 7:
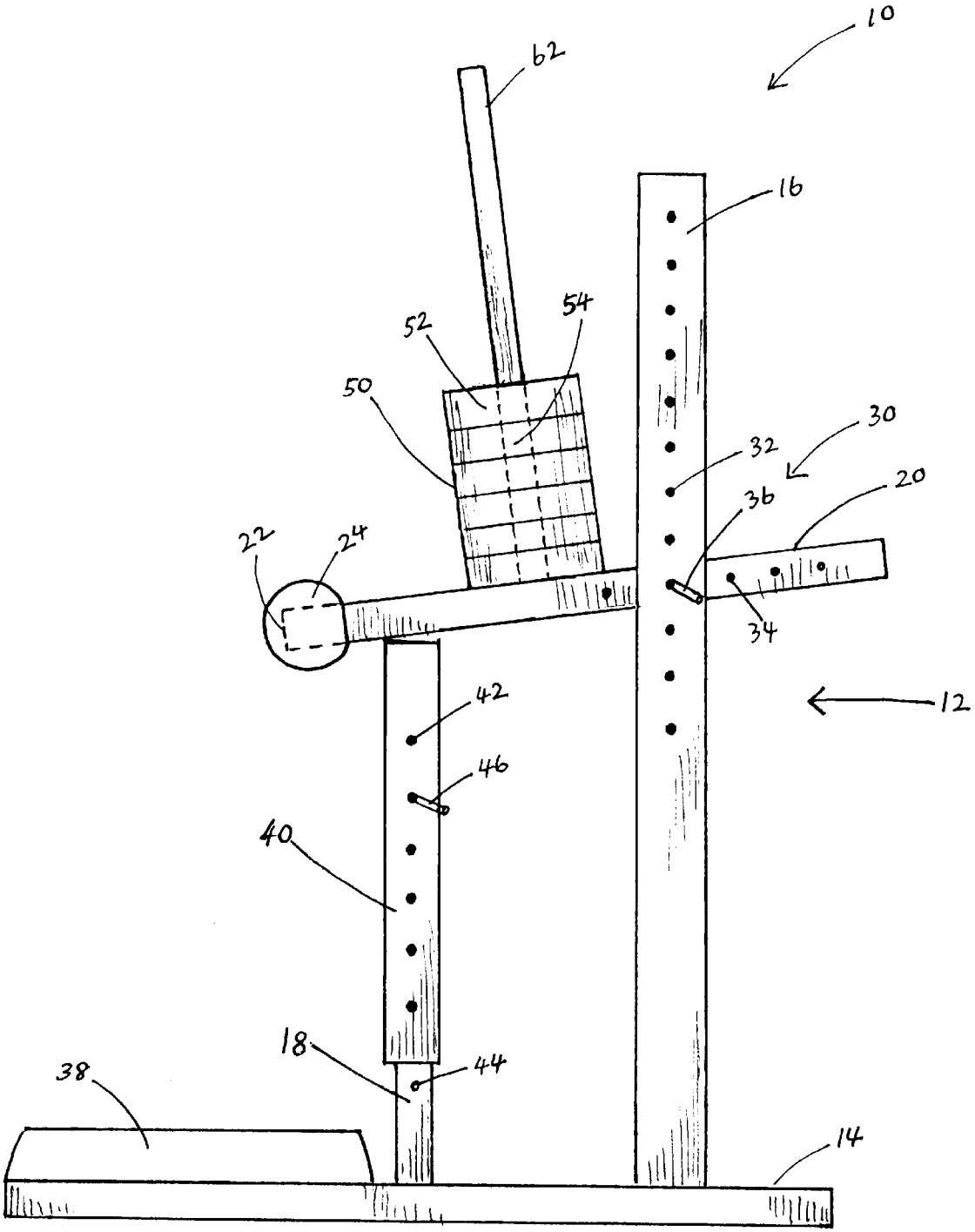
FIG. 7 is a side view of the embodiment of FIG. 6.

FIGS. 6 and 7 illustrate both perspective and side views of the anterior loading apparatus (10) of the present invention with an alternative location of the plurality of weights (50). Instead of coupling the plurality of weights (50) underneath the loading beam (20), the apparatus in FIGS. 6 and 7 has the plurality of weights (50) mounted upon and situated above the loading beam (20). A vertical holding post (62) is mounted on the loading beam (20) at about the mid-section thereof and adapted to hold the plurality of weights (50) by extending upwardly through the aligned, vertical central openings (54) in the stacked weight discs (52), whereby the vertical holding post (62) holds a selected number of weight discs (52) on the loading beam (20) which applies a vertical load to the loading beam and its free end (22) as similarly as that in the apparatus (10) which has the weights (50) mounted to and situated under the loading beam (20).

Figure 8:
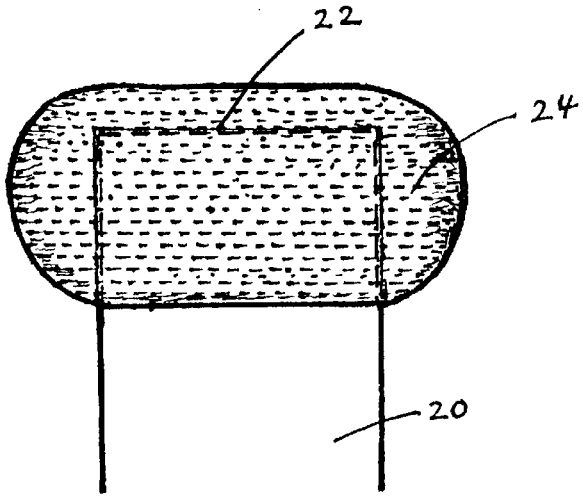
FIG. 8 is an enlarged front view of the straight-edged free end bearing a pad.
Figure 9:
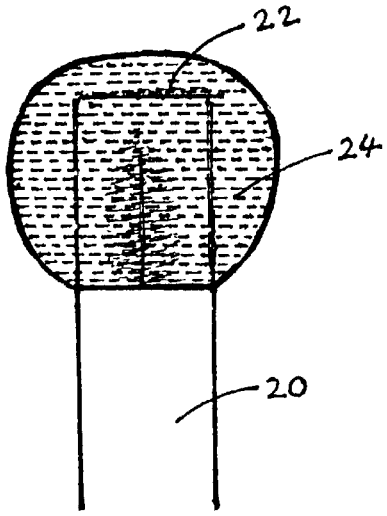
FIG. 9 is an enlarged side view of the straight-edged free end bearing a pad.
Figure 10:
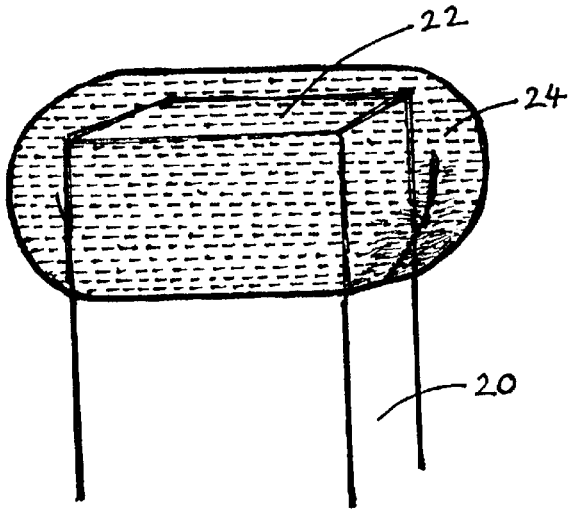
FIG. 10 is an enlarged perspective view of the straight-edged free end bearing a pad.

FIGS. 8, 9 and 10 illustrate the straight-edged free end (22) of the loading beam (20) with a pad (24) encircling thereon. The pad (24) is preferably made of a generally padding material such as sponge, cloth, foam, rubber or the like, preferably shaped as a cylinder transversely oriented to the axis of the loading beam (20), having both ends rounded and dimensioned to be comparable with the dimension of the straight-edged free end (22). The pad (24) is adapted to engage with the recess at the base of the front neck (4) of the user and to minimize the discomfort from an extended period of applying a compressive force onto top of the torso of the user (2). The thickness of the pad (24) at the outermost end of the straight-edged free end (22) is adapted with a minimal thickness of approximately not more than 0.5 inch so that it does not obstruct the proper engagement of the free end (22) with the recess of the neck at its front base (4) which may facilitate a direct loading of a desired vertically compressive force on top of the user's anterior torso axis.

Therefore, the present invention anterior loading apparatus is just a simple weight bearing exercise machine which does not need any movement or range of motion of the patient or user. By using weights to simulate the pull of gravity, the weak point of the spinal column commonly localized in the convex side of the lumbar spinal region can be strengthened. The convex side of the lumbar spine is hidden in the human torso and susceptible to the underused state. Hence, to direct a gravitational effect to condition this hidden region of the lumbar spine, it is demonstrated in the present invention anterior loading apparatus that the problem region can be accessed through top of the anterior torso.

In the drawings and specification, there has been set forth the best mode presently contemplated for the practice of the present invention, and although specific terms are employed, they are used in a generic and descriptive sense only and not for purposes of limitation, the scope of the invention being defined in the claims.

What I claim as my invention is:

1. An anterior loading, torso, spinal and posture training exercise apparatus comprising:

a base member;

a pair of substantially vertical frame members affixed to and extending upwardly from said base member;

a substantially vertical, medial torso support means affixed to and extending upwardly from said base member, said medial torso support means spaced from said vertical frame members and aligned with a mid-plane of said pair of vertical frame members;

said medial torso support means having a substantially straight front surface sized and configured to snugly engage a user's medial abdomen when the user's upright body is positioned adjacently facing and leaning against said medial torso support means, said medial torso support means having a terminal top end;

a loading beam having first end pivotally mounted in between said pair of vertical frame members at an upper section thereof and a second end extending outwardly beyond and above the terminal top end of said medial torso support means and terminating in a liftable straight-edged free end;

said liftable straight-edged free end of said loading beam sized and configured to engage with the base of the front neck of a user;

a plurality of weights mounted to a mid-section of said loading beam for loading said loading beam downwardly;

a pad encircling said straight-edged free end of said loading beam for minimizing the discomfort at the loading area at the top of a user's anterior torso due to an extended period of loading operation;

said pad having a predetermined thickness at its outermost end adapted to allow a proper engagement of said straight-edged free end with the base of a user's front neck, defined on top of a user's anterior torso axis;

said liftable straight-edged free end is located on said base relative to said medial torso support means so that a user positioned in an upright position has their chest and medial abdominal region snugly engaged with the front surface of said medial torso support means and has the base of the front of the neck engaged with said pad;

wherein a user engaging the base of the front of their neck with the pad of said anterior loading, torso, spinal and posture training exercise apparatus urges a user to straighten up, hold in the abdominal muscles and push forward the upper torso to resist the vertical load thereof and lift said straight-edged free end which in turn causes said loading beam to lift said plurality of weights upwardly;

wherein said anterior loading, torso, spinal and posture training exercise apparatus applies a compressive force to a user engaging the base of the front of their neck with the pad to strengthen the torso, inner spine, and particularly, the convex side of the lumbar spine and the muscles thereof;

wherein a user engaging the base of the front of their neck with the pad of said anterior loading, torso, spinal and posture training exercise apparatus trains a user to develop a desirable habit of holding straight and upright posture and discourages an undesirable habit of holding a slouching posture; and wherein a user engaging the base of the front of their neck with the pad of said anterior loading, torso, spinal and posture training exercise apparatus enables a user to perform a hand-free weightlifting exercise.

2. The anterior loading, torso, spinal and posture training exercise apparatus of claim 1 further comprising an adjustment means to selectively adjust said loading beam vertically and horizontally, to fit the chest level and the body dimension of a user.

3. The anterior loading, torso, spinal and posture training exercise apparatus of claim 1, wherein said vertical, medial torso support means is height adjustable, having a vertical extension slidably fitted on top of a bottom portion of said vertical, medial torso support means.

4. The anterior loading, torso, spinal and posture training exercise apparatus of claim 1, further comprising a cushion removably provided on said base member for receiving a weight bearing portion of a user's body.

5. The anterior loading, torso, spinal and posture training exercise apparatus of claim 1, wherein said plurality of weights is located underneath said loading beam between said pair of vertical frame members and said vertical, medial torso support means.

6. The anterior loading, torso, spinal and posture training exercise apparatus of claim 1, wherein said plurality of weights is mounted on and above said loading beam.

7. The anterior loading, torso, spinal and posture training exercise apparatus of claim 6, further comprising a vertical holding post mounted to the mid-section of said loading beam and extending upwardly therefrom for holding said plurality of weights thereon.

8. The anterior loading, torso, spinal and posture training exercise apparatus of claim 1, wherein said liftable straight-edged free end has a width at its outermost end comparable to the diameter of the human neck.

9. A method for strengthening a person's torso, inner spine, and muscles thereof, and training a person's upright posture and awareness of the proper spinal alignment, comprising the steps of:

the person positioning the front of their torso against a substantially upright, vertical torso support to support and maintain their upper torso in a static, stationary and upright position;

applying a vertically compressive force on top of the person's anterior torso axis by engaging a load interface that applies said force to the base of the front of the person's neck above the person's chest; and the person straightening up, holding in their abdominal muscles and pushing forward their upper torso to resist and lift the load interface for a period of time.

10. The method for strengthening a person's torso, inner spine, and muscles thereof, and training a person's upright posture and awareness of the proper spinal alignment of claim 9, wherein said load interface comprises a pad to provide a comfortable engagement with the person.

11. The method for strengthening a person's torso, inner spine, and muscles thereof, and training a person's upright posture and awareness of the proper spinal alignment of claim 9, wherein the person is positioned in an upright standing position.

12. The method for strengthening a person's torso, inner spine, and muscles thereof, and training a person's upright posture and awareness of the proper spinal alignment of claim 9, wherein the person is positioned in an upright kneeling position.

13. The method for strengthening a person's torso, inner spine, and muscles thereof, and training a person's upright posture and awareness of the proper spinal alignment of claim 9, wherein the period of time the person lifts the load interface is extended.

* * * * *